United States Patent [19]

Sakagami

[11] Patent Number: 4,567,021

[45] Date of Patent: Jan. 28, 1986

[54] U-SHAPED REACTION TUBE MADE OF ELASTIC MATERIAL

[75] Inventor: Toshio Sakagami, Chofu, Japan

[73] Assignee: Olympus Optical Company Limited, Tokyo, Japan

[21] Appl. No.: 434,877

[22] Filed: Oct. 18, 1982

[30] Foreign Application Priority Data

Oct. 19, 1981 [JP] Japan ..... 56-165628

[51] Int. Cl.[4] ..... B01L 3/00

[52] U.S. Cl. ..... 422/102; 422/64

[58] Field of Search ..... 422/50, 55, 58, 99, 422/102, 92, 64, 104; 141/331-334, 337, 340; 73/441; 356/246

[56] References Cited

U.S. PATENT DOCUMENTS 3,740,157 6/1973 Kasparek ..... 356/246
3,860,347 1/1975 Jones ..... 356/246
3,998,594 12/1976 Horne ..... 356/246
4,119,125 10/1978 Elkins ..... 422/100 X
4,310,488 1/1982 Rahm et al. ..... 422/102

*Primary Examiner*—Barry S. Richman
*Assistant Examiner*—Michael S. Gzybowski
*Attorney, Agent, or Firm*—Parkhurst & Oliff

[57] ABSTRACT

A U-shaped reaction tube used as a reaction tube for a sample analysis in an automatic chemical analyzer and its manufacturing method are disclosed. The U-shaped reaction tube having a cup portion having a large radius, a U-shaped tube portion having a small radius and a tapered end portion having a small radius is formed in one body with elastic material such as a thermoplastic resin by an injection molding. Two pairs of flanges are arranged on an outer surface of the cup portion and a circular flange is arranged on an outer surface of the U-shaped tube, so that the U-shaped reaction tube can be easily secured to a holding plate without a cement in a detachable manner.

6 Claims, 7 Drawing Figures

U-SHAPED REACTION TUBE MADE OF ELASTIC MATERIAL

BACKGROUND OF THE INVENTION

The present invention relates to a U-shaped reaction tube for use in an automatic chemical analyzer and a method for manufacturing the same.

As described in U.S. Pat. No. 3,592,605, a known U-shaped reaction tube comprises a cup portion having a large radius for supplying sample and reagent therein, a substantially U-shaped tube portion having a small radius, one end being connected to the bottom of cup portion and a non-cupped end portion having a small radius connected to the other end of the U-shaped tube portion for connecting a pump therethrough, and these portions are integrally made of glass. The known tubes have been manufactured by a glass craft, and therefore, it is difficult to keep a manufacturing error within a predetermined accuracy range. Moreover, since openings of the cup and non-cupped end portions cannot be positioned accurately, it is not possible to discharge completely a sample solution or a washing liquid contained in the reaction tube.

Further, since the sample solution or the washing liquid is discharged through the opening of the non-cupped end portion under a vacuum suction pressure, it is necessary to connect a suction tube to the opening of the non-cupped end portion hermetically. To this end, it is necessary to polish the opening edge of the non-cupped end portion sufficiently or to arrange a resilient member at the tip of non-cupped end portion and thus, the reaction tube becomes expensive in cost and complicated in construction. Furthermore, since the U-shaped reaction tube is made of glass, it might break during use thereof. In the known analyzer, usually a plurality of U-shaped reaction tubes are secured by cement to a common mounting member and therefore, even if only one reaction tube is broken, the mounting member supporting a plurality of unbroken reaction tubes must be discarded, which results in a higher operating cost.

Moreover, a conventional U-shaped reaction tube made of glass has disadvantages that the glass itself has a hydrophilic property and is heavy in weight. That is to say, a washing liquid might remain on an inner wall of the test tube after washing to cause contamination between sample solutions. Further, a large number of the reaction tubes, such as three hundred, are arranged on a turret, resulting in the analyzer becoming heavy in weight and requiring a large driving mechanism for rotating the heavy turret.

SUMMARY OF THE INVENTION

The present invention has for its object to eliminate the drawbacks mentioned above and to provide a U-shaped reaction tube which can be detachably arranged to a holding means such as a turret and can be made of elastic material such as thermoplastic resin, manufactured by an injection molding process.

According to the invention, a U-shaped reaction tube for use in an automatic chemical analyzer comprises a cup portion made of elastic material and having a large radius;

a U-shaped tube portion made of elastic material and having a small radius, one end of the U-shaped tube portion being coupled with a bottom end of said cup portion and the other end being extended to a level near that of an upper portion of said cup portion; and a non-cupped end portion made of elastic material and coupled with the other end of said U-shaped tube portion; whereby said cup portion, U-shaped tube portion and non-cupped end portion are formed in one body.

Another object of the invention is to provide a method for forming the above U-shaped reaction tube.

According to the invention, a method for manufacturing a U-shaped reaction tube comprising a cup portion, a U-shaped tube portion, having one end connected to a bottom of the cup portion, and a non-cupped end portion connected to the other end of the U-shaped tube portion comprises the steps of forming the U-shaped tube portion with elastic material;

setting said U-shaped tube portion in an injection mold having inner spaces corresponding to said cup portion and non-cupped end portion; and heating said U-shaped tube, while a thermoplastic resin is injected into said mold.

DESCRIPTION OF THE PREFERRED EMBODIMENTS

Figure 1A:
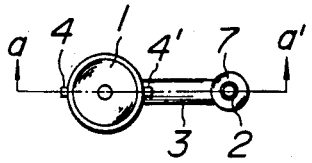
FIG. 1A is a plan view showing one embodiment of the U-shaped reaction tube according to the invention.
Figure 1B:
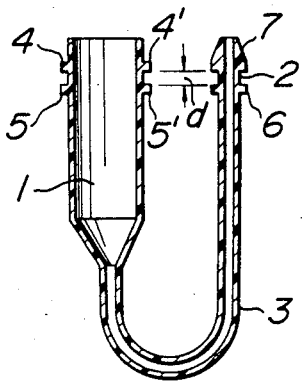
FIG. 1B is a cross sectional view cut along a line a—a' in FIG. 1A.

FIG. 1A is a plan view showing one embodiment of the U-shaped reaction tube according to the invention and FIG. 1B is a cross sectional view illustrating the tube cut along a line a—a' in FIG. 1A. In FIGS. 1A and 1B, a cup portion 1 for containing a liquid therein is connected through a U-shaped tube portion 3 to a non-cupped end portion 2 which is further connected to a pump. According to the invention, these three portions 1, 2 and 3 are formed in one body with elastic material such as polypropylene and polycarbonate. The reaction tube may preferably be made of polypropylene, because it has a high chemical resistance, non-hydrophilic properties and excellent moldability. The U-shaped tube portion 3 can be formed by various known methods, and the cup portion 1 and the non-cupped end portion 2 are formed by a known injection molding method using an injection mold. Moreover, two pairs of flanges 4, 4' and 5, 5' are integrally formed on an outer surface of the cup portion 1 with a distance d therebetween which is a little larger than a thickness of a holding plate such as a turret (not shown) for holding the U-shaped reaction tubes according to the invention. Also, circular flanges 6, 7 are integrally formed on an outer surface of the non-cupped portion 2 with the distance d therebetween. The upper circular flange 7 is so tapered that it is easily connectable to a suction and discharge tube which is further coupled with a pump, not shown in drawings.

Figure 2A:
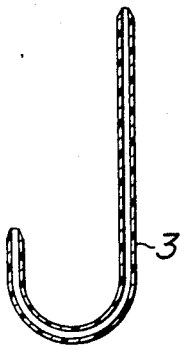
FIGS. 2A and 2B and FIG. 3 are cross sectional views for explaining successive steps of the U-shaped reaction tube manufacturing method according to the invention.
Figure 2B:
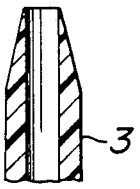

FIGS. 2A and 2B are cross sectional views explaining one embodiment of the manufacturing method according to the invention. At first, as shown in FIG. 2A, a U-shaped tube 3 having a small radius and made of plastics is prepared, both ends of which are tapered as shown in FIG. 2B. Then, the U-shaped tube 3 is set in an injection mold having inner spaces corresponding to the cup portion 1 and non-cupped end portion 2 shown in FIG. 1B, and while a thermoplastic material is injected into the injection mold, the tapered ends of the U-shaped tube 3 are melted and fused to the cup and non-cupped end portions, respectively. In this manner, the U-shaped reaction tube according to the invention can be formed easily into a unitary body.

Figure 3:
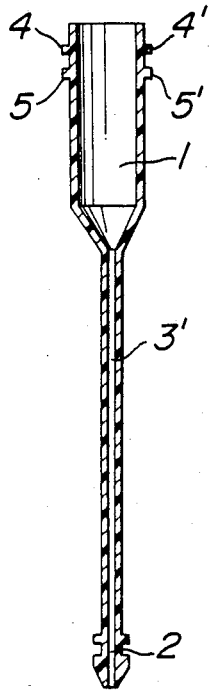

FIG. 3 is a cross sectional view explaining another embodiment of the U-shaped reaction tube manufacturing method according to the invention. As shown in FIG. 3, a straight tube-shaped blank consisting of the cup portion 1, a straight tube portion 3', and the non-cupped end portion 2 are formed into a unitary body by the injection molding of thermoplastic resin. Subsequently, the straight tube portion 3' is bent into a U-shape by applying a heat thereto so that the U-shaped reaction tube according to the invention having a sufficient elasticity can be formed in one body.

According to the methods mentioned above, since the cupped and non-cupped end portions 1 and 2 are connected to the U-shaped tube 3 or 3' in one body, by an injection molding, process smooth boundary portions without a step can be obtained and thus it is possible to eliminate the possibility of any sample solution or washing liquid remaining within the U-shaped reaction tube at such boundary portions during a discharging operation. It is a matter of course that the whole U-shaped reaction tube according to the invention consisting of the cup portion 1, the non-cupped end portion 2 and the U-shaped tube portion 3 may be integrally formed by means of a single injection mold.

Figure 4A:
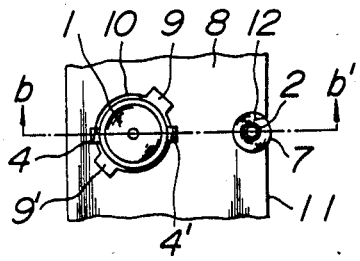
FIG. 4A is a plan view showing one embodiment of the U-shaped reaction tube arranged detachably on a holding means.
Figure 4B:
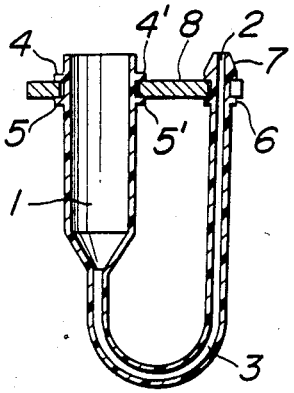
FIG. 4B is a cross sectional view cut along a line b—b' in FIG. 4A.

FIG. 4A is a plan view showing one embodiment of the U-shaped reaction tube arranged detachably on a holding means and FIG. 4B is a cross sectional view made along a line b—b' in FIG. 4A. In FIGS. 4A and 4B, a holding means 8 comprises a hole 10 having diagonally aligned cut-out portions 9, 9' for passing through the flanges 4 and 4' of the cup portion 1 and a U-shaped cut-out portion 12 into which the non-cupped end portion 2 is inserted from a peripheral end 11 of the holding means 8. In such a construction, since the U-shaped reaction tube made of plastics has a large elasticity, the U-shaped reaction tube can be simply and accurately secured to the holding means 8 without any cement. In addition, it is easy to remove the U-shaped reaction tube, when necessary.

As explained above, according to the invention, since at least the cup portion 1 and the non-cupped end portion 2 can be formed accurately by the injection molding using the injection mold, it is possible to maintain a correct positional relation between each opening of the cup portion 1 and the non-cupped portion 2. In addition, the cup portion 1, the non-cupped end portion 2 and the U-shaped tube portion 3 are formed in a unitary body of elastic material and therefore, the boundary portions therebetween are smooth resulting in the sample solution or the washing liquid contained in the U-shaped reaction tube not remaining within the tube at the boundary portions. Moreover, the plastics used to make the tube have such a high repellency property that a remaining liquid can be reduced materially after washing the U-shaped reaction tube. Further, since use is made of plastics instead of glass, which is typically used in a conventional reaction tube, it is possible to eliminate breakage of the reaction tube during handling. The reaction tube according to the invention can be formed by injection molding which attains a highly accurate dimension. Moreover, when the circular flange 7 of a desired shape is formed in the non-cupped end portion 2, the reaction tube can be easily connected to the suction and discharge tube which is further coupled with the pump and the non-cupped end portion can be effectively coupled with the pump system without any special connecting means.

Furthermore, when the flanges 4, 4', 5, 5' and circular flanges 6, 7 are formed on the peripheral portions of the cup portion 1 and the non-cupped end portion 2, respectively, it is possible to arranged detachably the U-shaped reaction tubes to the holding means 8 without cementing the reaction tubes to the holding means. That is to say, the U-shaped reaction tubes according to the invention can be secured detachably to the holding member. Therefore, if the reaction tube breaks only the broken test tube must be replaced. In addition, since the U-shaped reaction tube is light in weight, even if a great number of the reaction tubes according to the invention are provided in the automatic analyzer, a weight of the reaction tube turret is still very small and thus, the mechanism for driving the turret can be made small and simple, so that the whole analyzer can be inexpensive.

What is claimed is:

1. A U-shaped reaction tube for use in an automatic chemical analyzer, comprising:

a cup portion made of elastic material, having a first end and a second end, and an area between said first end and said second end having a predetermined first radius;

a U-shaped tube portion made of elastic material, said tube portion having a predetermined second radius less than said predetermined first radius of the cup portion, a first end of the U-shaped tube portion being coupled with said second end of said cup portion and a second end extending to a plane near said first end of said cup portion; and a non-cupped end portion made of elastic materials and coupled with said second end of said U-shaped tube portion, whereby said cup portion, said U-shaped tube portion and said non-cupped end portion are a unitary body such that the cup portion can be twisted about its longitudinal axis and can be shifted laterally with respect to the non-cupped end portion;

wherein the elastic materials are of an analytical quality so that they will not react substantially with substances to be tested in the reaction tube, and the reaction tube is sized for use in large quantity in an automatic chemical analyzer.

2. The reaction tube of claim 1, wherein said elastic material is a thermoplastic resin selected from the group consisting of polypropylene and polycarbonate.

3. The reaction tube of claim 1, further comprising:

first and second pairs of radially extending flanges situated on diametrically opposite outer surfaces of said cup portion in the area of the first predetermined radius thereof, said first and second pairs of flanges being disposed a given axial distance apart.

4. The reaction tube of claim 3, further comprising a third pair of annular flanges arranged on an outer surface of said non-cupped end portion, said annular flanges of said third pair having a given axial distance therebetween equal to said given axial distance between said first and second pairs of flanges on said cup portion.

5. The reaction tube of claims 3 or 4, wherein said given axial distance is slightly larger than a thickness of a plate-like member to which said reaction tube is removably secured by said first pair of flanges contacting a first surface of said plate-like member and said second pair of flanges contacting a second surface of said plate-like member.

6. The reaction tube of claim 5, wherein one of said third pair of annular flanges has a tapered shape which is easily connectable to a suction and discharge tube.

* * * * *